United States Patent [19]

Kobayashi

[11] Patent Number: 4,949,662

[45] Date of Patent: Aug. 21, 1990

[54] STEERING DEVICE FOR SMALL SIZED JET PROPULSION BOAT

[75] Inventor: Noboru Kobayashi, Iwata, Japan

[73] Assignee: Yamaha Hatsudoki Kabushiki Kaisha, Iwata, Japan

[21] Appl. No.: 266,111

[22] Filed: Nov. 2, 1988

[51] Int. Cl.[5] ..... B63H 25/06

[52] U.S. Cl. ..... 114/162; 114/163; 114/270; 440/42

[58] Field of Search ..... 114/162, 163, 165, 164, 114/270; 440/40, 42, 43

[56] References Cited

U.S. PATENT DOCUMENTS 1,780,767 11/1930 Scott-Paine ..... 114/163
3,083,382 4/1963 Havens et al. ..... 114/61
3,397,670 8/1968 Bedford ..... 114/270
3,426,724 2/1969 Jacobson ..... 114/270
4,779,553 10/1988 Wildhaber, Sr. ..... 114/151

FOREIGN PATENT DOCUMENTS 94894 7/1980 Japan ..... 114/162

*Primary Examiner*—Sherman D. Basinger
*Attorney, Agent, or Firm*—Ernest A. Beutler

[57] ABSTRACT

An improved steering arrangement for a jet propelled watercraft including a rudder carried by the forward portion of the hull and which is out of the water at high speeds and submerged at low speeds for assisting in low speed steering without adding to high speed drag. The rudder and the steering nozzle of the jet propulsion unit are steered simultaneously.

8 Claims, 3 Drawing Sheets

STEERING DEVICE FOR SMALL SIZED JET PROPULSION BOAT

BACKGROUND OF THE INVENTION

This invention relates to a steering device for a small sized jet propulsion boat and more particularly to an improved steering arrangement for a watercraft.

Various forms of devices have been provided for steering watercraft. In connection with many of these steering devices, their efficiency depends upon the speed of travel of the watercraft. Devices that are responsive under certain running conditions, may not be particularly responsive under other running conditions. Certain forms of steering devices also are particularly effective at some speeds, but adversely effect the performance such as maximum speed at other speeds due to their drag.

This problem is particularly true with respect to jet propelled watercraft. With this type of watercraft, a jet propulsion unit draws water from the body of water in which the watercraft is operating and discharges it through a pivotally supported steering nozzle for both propelling and steering the watercraft. Although this type of steering device is particularly advantageous under normal running conditions, at low speeds the jet propulsion unit does not develop any significant thrust and the steering effects are substantially reduced.

It is, therefore, a principal object of this invention to provide an improved steering device for a watercraft.

It is a further object of this invention to provide an improved steering arrangement for jet propelled watercraft.

It is a yet further object of this invention to provide a steering system for a small jet propelled watercraft that will provide effective steering under all running characteristics.

SUMMARY OF THE INVENTION

This invention is adapted to be embodied in a watercraft having a hull and propulsion means carried by the hull for propelling the hull through a body of water. Steering means are supported contiguous to the stern of the hull for steering of the watercraft. The configuration of the hull is such that a forward portion thereof is submerged when travelling at low speeds and is out of the water when the hull is being propelled at high speeds by the propulsion means. In accordance with this feature of the invention, auxiliary steering means are carried by the hull forward position and are ineffective to effect a steering effect when the watercraft is travelling at high speeds but create a steering effect when the watercraft is traveling at low speeds.

DETAILED DESCRIPTION OF THE PREFERRED EMBODIMENT OF THE INVENTION

Figure 1:
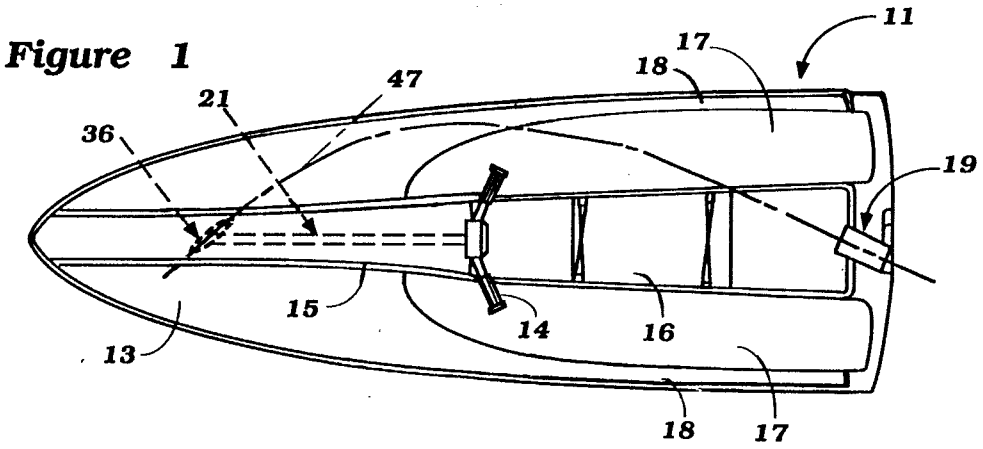
FIG. 1 is a top plan view of a small watercraft constructed in accordance with an embodiment of the invention.

In the drawings, a small watercraft constructed in accordance with an embodiment of the invention is identified generally by the reference numeral 11. The small watercraft 11 is comprised of a hull 12 that has a bow portion 13. A steering handlebar 14 is supported to the rear of the bow 13 and is connected by a steering mechanism, to be described, to steering devices of the watercraft. The handlebar 14 is supported upon a raised mast assembly 15 in a manner which will be described.

Figure 3:
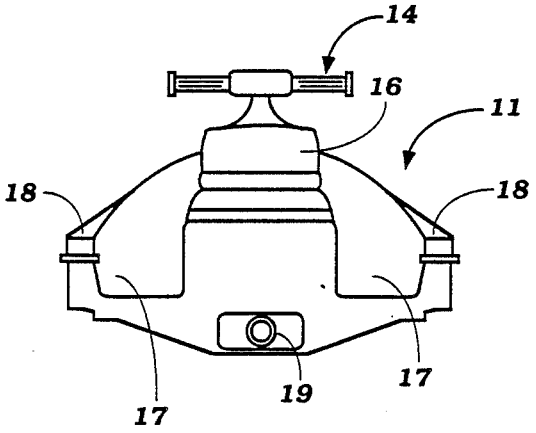
FIG. 3 is a rear elevational view of the watercraft.

Rearwardly of the mast 15 and in proximity to the handlebar 14 there is provided a rider's area which includes a seat 16 that is adapted to accommodate one or more riders seated in straddle fashion thereon. A pair of depressed foot wells 17 are disposed on opposite sides of the seat 16 and are adapted to receive the feet of the riders. A raised deck portion 18 surrounds the foot wells 17. As may be seen in FIG. 3, the foot wells 17 open through the rear of the hull 12 so as to permit water to flow from this area so as to facilitate reentry of a displaced rider.

The watercraft 11 is powered by an internal combustion engine (not shown) that is contained beneath the bow 13 and which drives a jet propulsion unit (not shown) that is disposed centrally of the hull 12 and beneath the seat 16. This jet propulsion unit has a discharge nozzle 19 that is supported for pivotal movement about a generally vertically extending axis for steering of the watercraft 11 in an known manner.

Figure 4:
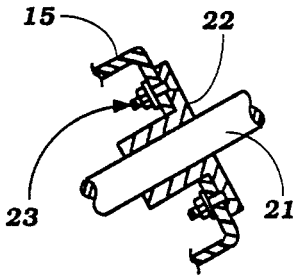
FIG. 4 is an enlarged cross-sectional view of the area encompassed by the circle 4 in FIG. 2 and taken through a plane parallel to that figure.

The handlebar assembly 14 is connected to a steering mast 21 that is, in turn, journaled by means of an upper bearing 22 in the mast 15 (FIG. 4). The bearing 22 is held in place by means of fasteners 23 and a seal of any known type is incorporated in this area to preclude leakage.

As may be best seen in FIG. 1, the steering mast 21 is connected to a further steering shaft 24 by means of a tongue 25 and groove 26 connection. Threaded fastening means 27 extend through openings 28 and 29 in the mast 21 and steering shaft 24 so as to provide a coupling, indicated generally by the reference numeral 31, that permits angular misalignment between the mast 21 and shaft 24 while still transmitting the steering forces therebetween.

Figure 7:
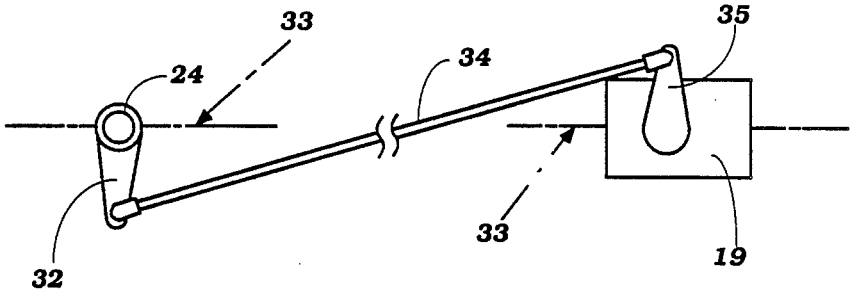
FIG. 7 is a top plan view showing the steering linkage.

As may be seen best in FIG. 7, a steering arm 32 is affixed to the steering shaft 24 and extends on one side of a longitudinal center line 33 when the handlebar 14 and steering nozzle 19 are in their straight ahead position. A steering link 34 interconnects the steering arm 32 with a further steering arm 35 that is affixed to the steering nozzle 19 and which extends on the other side of the plane 33 when in the straight ahead position. As may be readily apparent, steering of the handlebar assembly in a clockwise direction as shown in FIG. 7 will result in steering of the steering nozzle 19 in a counterclockwise direction so as to turn the watercraft 11 to the right. Rotation in the opposite direction will, of course, effect steering in the opposite direction.

Figure 5:
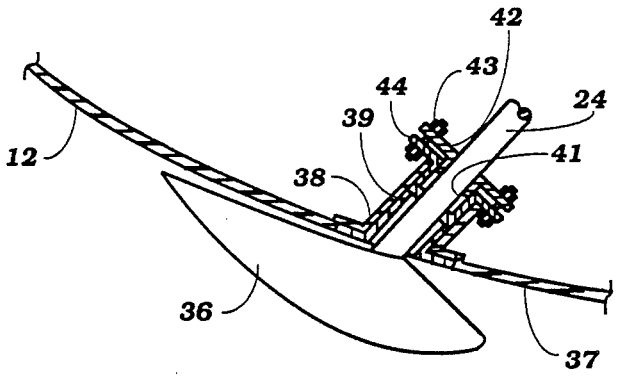
FIG. 5 is an enlarged cross-sectional view taken through the same plane as FIG. 4 and showing the area encompassed by the circle 5 in FIG. 2.
Figure 6:
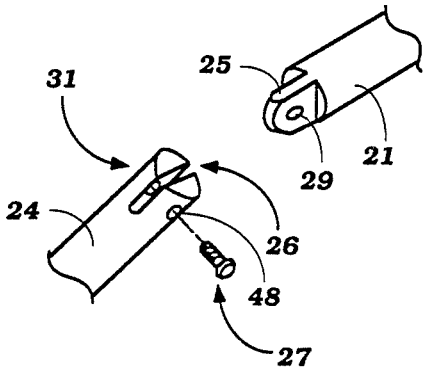
FIG. 6 is an exploded perspective view, on an enlarged scale, showing the area encompassed by the circle 6 in FIG. 2.

It should be noted that the use of the jet propulsion steering nozzle 19 provides very good steering inputs and steering reaction under high speed running. However, under low speeds when relatively low thrust is being exerted, the steering is not as precise as could be desired. In order to provide good steering under even this condition, an auxiliary steering device in the form of a forwardly positioned rudder 36 is provided. The rudder 36 is connected directly to the steering shaft 24 as clearly shown in FIG. 5. The rudder 36 is positioned in a forward portion 37 of the hull 12 for a reason to be described. In this area, the hull 12 is provided with a cylindrical, inwardly extending projection 38 that receives a reenforcing member 39 and which surrounds the lower end of the steering shaft 24. A packing 41 is interposed between the steering shaft 24 and the hull and is loaded by means of a compression plate 42 and bolt and nut assemblies 43 against a flange 44 of the packing receiver so as to load the packing and prevent leakage in this area.

Figure 2:
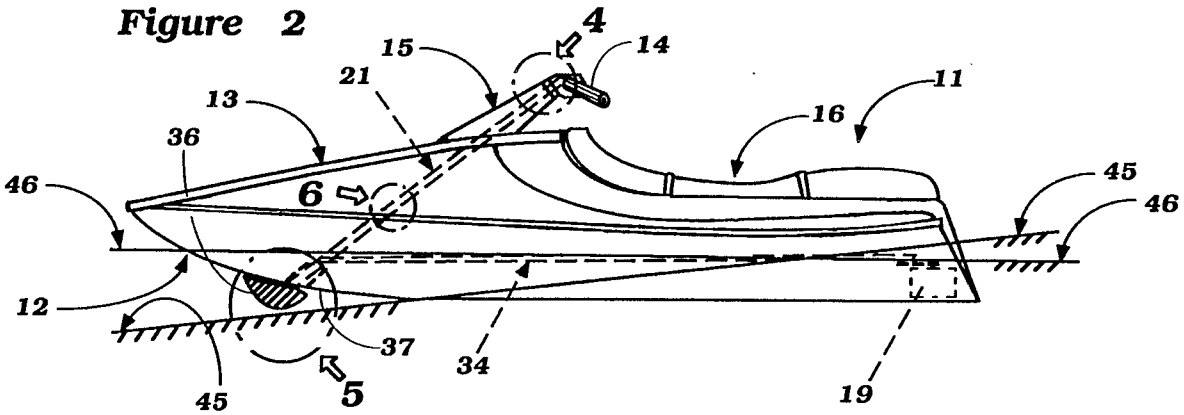
FIG. 2 is a side elevational view of the watercraft.

It should be noted that the angular position of the hull 12 relative to the water line when traveling at high speeds is indicated by the line 45 in FIG. 2. Under this condition, the auxiliary steering rudder 36 is out of the water and will offer no resistance to travel. Furthermore, under this condition there will obviously be no steering effect generated by the rudder 36. However, when the watercraft is traveling at low speeds, the hull portion 37 will be submerged as the waterline will now be along the line 46. As a result, the rudder 36 will be submerged and will assist in the steering effect of the nozzle 19.

As may be readily seen in FIG. 1, the rudder 36 and steering nozzle 19 are steered in opposite directions by the steering linkage described and thus these two elements act in concert to further improve the steering in the desired direction. The dot-dash line 47 in FIG. 1 shows how the steering nozzle and rudder cooperate due to the fact that their effective steering forces operate across this line.

It should be readily apparent from the foregoing description that a very effective arrangement is provided for assisting in the steering of a small watercraft under all conditions without adding unnecessarily to the drag of the hull. The description is, of course, that of a preferred embodiment of the invention and various changes and modifications may be made without departing from the spirit and scope of the invention, as defined by the appended claims.

I claim:

1. In a watercraft having a hull, propulsion means carried by said hull for propelling said hull through a body of water, steering means supported contiguous to the stern of said hull for steering said hull, the configuration of said hull being such that a forward portion thereof is submerged when taveling at low speeds and is out of the water when said hull is being propelled at high speeds by said propulsion means, the improvement comprising auxiliary steering means carried by said hull forward portion and being ineffective to effect a steering effect when said watercraft is traveling at high speeds and to create a steering effect when said watercraft is traveling at low speeds.

2. In a watercraft as set forth in claim 1 wherein the auxiliary steering means comprises a rudder that is out of the water when traveling at high speeds and submerged when traveling at low speeds.

3. In a watercraft as set forth in claim 1 wherein the auxiliary steering means and the steering means are operated by a common steering control.

4. In a watercraft as set forth in claim 3 wherein the auxiliary steering means comprises a rudder that is out of the water when traveling at high speeds and submerged when traveling at low speeds.

5. In a watercraft as set forth in claim 1 wherein the water propulsion means comprises a jet propulsion unit and the steering means is an adjustable steering nozzle thereof.

6. In a watercraft as set forth in claim 5 wherein the auxiliary steering means comprises a rudder that is out of the water when traveling at high speeds and submerged when traveling at low speeds.

7. In a watercraft as set forth in claim 6 wherein the auxiliary steering means and the steering nozzle are operated by a common steering control.

8. In a watercraft as set forth in claim 7 wherein the hull is designed to be operated by a single rider sitting in straddle fashion thereon.

* * * * *